United States Patent [19]

Morita

[11] Patent Number: 4,589,579

[45] **Date of Patent: * May 20, 1986**

[54] TONER VESSEL FOR COPYING MACHINE

[75] Inventor: Yoshiharu Morita, Numazu, Japan

[73] Assignee: Ricoh Co., Ltd., Tokyo, Japan

[ * ] Notice: The portion of the term of this patent subsequent to Mar. 4, 2003 has been disclaimed.

[21] Appl. No.: 606,071

[22] Filed: May 1, 1984

[30] Foreign Application Priority Data

May 18, 1983 [JP] Japan ..... 58-74120[U]

[51] Int. Cl.[4] ..... B65D 47/00; B67D 3/00

[52] U.S. Cl. ..... 222/561; 222/DIG. 1

[58] Field of Search ..... 222/532, 536, 541, 542, 222/544, 559, 561, DIG. 1, 148, 149, 423; 220/255, 256, 258, 334, 345, 350, 351, 359

[56] References Cited

U.S. PATENT DOCUMENTS 3,999,654 12/1976 Pollack ..... 206/216

4,062,385 12/1977 Katusha et al. ..... 222/544 X

*Primary Examiner*—Joseph J. Rolla

*Assistant Examiner*—Michael S. Huppert

*Attorney, Agent, or Firm*—Flynn, Thiel, Boutell & Tanis

[57] ABSTRACT

A toner vessel for use in a copying machine includes a square dish-shaped vessel body which is opened at the upper part, is provided with an outwardly projecting flange at the peripheral edge of said opening and receives the toner therein. The opening of the vessel body is covered with a lower part of a twice-folded cover sheet and its periphery is fitted on said flange. A cover plate, covering the lower part of this cover sheet, is mounted on the vessel body movably in the horizontal direction. A slit is provided in a place on the portion of this cover plate near the folded portion of the cover sheet, and simultaneously a projection for removing the toner is provided on the inside in the neighborhood of this slit on the side opposite to the folded portion. A folded upper portion of the cover sheet is designed to pass through the slit and then extend through the head of the projection for removing the toner along the back of the cover plate.

3 Claims, 7 Drawing Figures

TONER VESSEL FOR COPYING MACHINE

FIELD OF THE INVENTION

This invention relates to a toner vessel for use in a copying machine.

CROSS-REFERENCE

The invention described in the present application is related in certain respects to U.S. Ser. No. 527,132 filed Aug. 26, 1983.

BACKGROUND OF THE INVENTION

As the conventional vessel of this type, there is known the one illustrated in FIG. 1A. This vessel 1 includes a square dish-shaped vessel body 2 which is opened at the upper part and provided with an outwardly projecting flange 3 at the peripheral edge portion of the opening. A toner 4 is received in this vessel body 2. A twice-folded cover sheet 5 comprises a lower part 6 and an upper part 7, the former covering the opening, the latter, which is superposed on the former, extending its fore end part 8 outside of the flange 3.

When supplying the toner 4 in the developing area of the copying machine (not shown) by using the toner vessel of this type, the toner vessel is turned upside down, as shown in FIG. 1B, and applied to a copying machine for use. The sheet 5 is peeled off from the flange 3 by pulling the sheet in the direction of the arrow with the end part 8, and thus the opening of the body 2 is gradually opened, whereby the toner 4 is allowed to fall into the developing area of the copying machine.

The conventional vessel of this type, however, was defective in that upon peeling the lower part 6 of the sheet 5 from the flange 3, the part 6 must be pulled out of the vessel 2, but the toner 4' adhered to the back of the lower part 6 comes to fall, at that time, inside or outside of the copying machine other than its developing area, thereby staining those parts.

In view of this, the assignee of the invention disclosed in this application has proposed a toner vessel, which is capable of eliminating the above mentioned disadvantage. The aforesaid application U.S. Ser. No. 527,132, has previously been assigned to the assignee of the present application.

The thus proposed toner vessel is the one illustrated in FIG. 2A, which will be explained in such a manner that the same reference numerals are attached to the same components as the prior art for the purpose of omitting the description thereof. The detailed description contained herein is directed mainly to the Applicant's improvement.

On the upper portion 7 of the sheet 5 is disposed the cover plate 9. Both its side flanges are bent inside to form bent portions 10. Both side flanges 3 are fitted in groove portion formed by said bent portions 10. The plate 9 is designed to be movable along the flanges 3 in the horizontal direction. The slit 11 is provided near the rear end of the plate 9. The upper portion 7 of the sheet 5 is folded back upwards at the forward end of the plate 9 and further inserted inside from this slit 11, thereby pulling the end portion 8 outside along the upper surface of the lower portion 6.

The method of using this toner vessel is shown in FIG. 2B, wherein when pulling the sheet in the direction of the solid arrow with the end portion 8, the upper portion 7 of the sheet 5 is first pulled out of the vessel 2 together with the plate 9, and when further pulling the sheet 5 while holding the plate 9 in place, the toner-free upper portion 7 is pulled out of the plate 9 and at the same time the toner-adhered lower portion 6 is peeled off from the vessel 2 and pulled out on the back of the plate 9. In this case, the toner 4 adhered to the lower portion 6 is stripped off by the flange to the slit 11 and is deposited into the developing area, and the remaining adhering toner 4 sometimes falls down on the back of the plate 9 but never falls into other places outside the developing areas. After the toner within the vessel 2 has wholly been deposited in the developing area, the plate 9 is moved in the direction of the dotted arrow to cover the vessel 2. The toner vessel and plate assembly are then removed from the copying machine. Thus, the environmental pollution caused by the toner falling outside the developing area can be prevented.

The toner vessels illustrated in FIG. 2A and FIG. 2B are as explained above, and are superior to those illustrated in FIG. 1A and FIG. 1B. Nevertheless, the former vessels had disadvantages in that removing the toner from the lower portion of the sheet 6 was not fully satisfactory.

SUMMARY OF THE INVENTION

The object of this invention is to provide a toner vessel which is capable of eliminating the above mentioned drawbacks inherent in the conventional toner vessels of various kinds and is capable of preventing, upon application of the toner in the copying machine, the toner from falling on the inside and outside portions other than the developing area of said copying machine more effectively, thereby preventing said portions from being stained.

Said object can be achieved by providing a toner vessel of this invention which comprises attaching a toner-removing projection to the back of the cover plate of the toner vessel shown in FIGS. 2A and 2B ahead of the advancing direction of the cover sheet and adjacently to the slit.

As seen in the embodiment of the invention, the use of said projection made of sponge permits removal of the toner almost completely, whereby contamination can be prevented more effectively.

DETAILED DESCRIPTION OF THE INVENTION

Figure 1A:
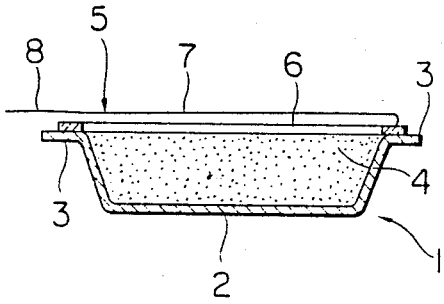
FIG. 1A PRIOR ART
FIG. 1A is a longitudinal sectional view of a typical toner vessel for use in a copying machine.
Figure 1B:
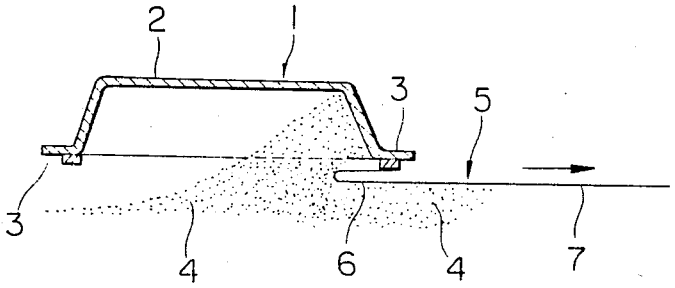
FIG. 1B PRIOR ART
FIG. 1B is a longitudinal sectional view showing the method of using said toner vessel shown in FIG. 1A.
Figure 2A:
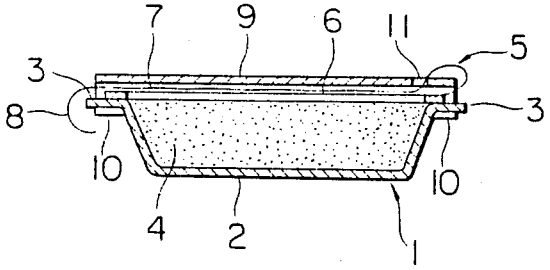
FIG. 2A is a longitudinal sectional view of a toner vessel of the invention disclosed in the patent application obtained by the assignee previously by assignment.
Figure 2B:
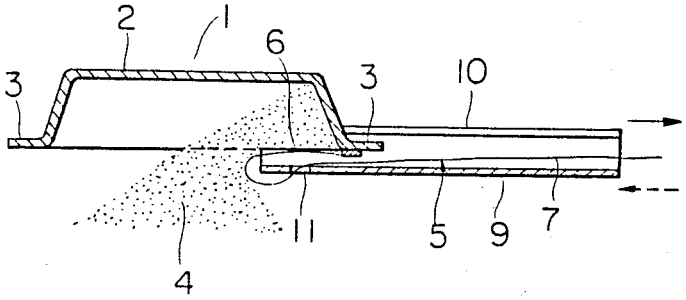
FIG. 2B is a longitudinal sectional view of the method of using the toner vessel shown in FIG. 2A.
Figure 3:
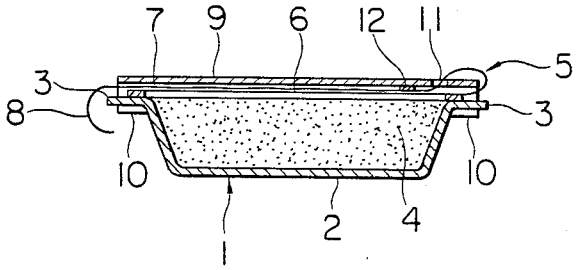
FIG. 3 is a longitudinal sectional view of a toner vessel embodying this invention.
Figure 4:
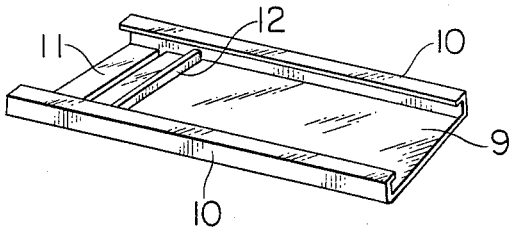
FIG. 4 is a perspective view of the back of a cover plate of said toner vessel shown in the embodiment of FIG. 3.
Figure 5:
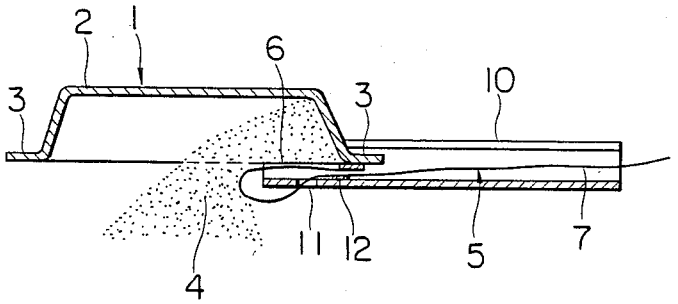
FIG. 5 is a longitudinal sectional view illustrating the method of using the embodiment of FIG. 3.

In FIG. 3 to FIG. 5 there is shown one embodiment of a toner vessel according to this invention. In this embodiment, it is to be noted that since this embodiment holds many of the same structural points in common with those shown in FIGS. 2A and 2B, the same symbols will be attached to such parts for the purpose of abridging the description thereof, and a description will be made mainly in reference to differences therebetween.

This embodiment, as is apparent in particular from FIG. 4, is characterized in that a cover plate 9 is provided with a sponge-like projection 12 on the back of the cover plate 9 ahead of the advancing direction of a cover sheet 5, adjacently to a slit 11 and substantially in parallel with the slit 11. This projection 12 may be made of a material other than sponge.

FIG. 5 illustrates the manner of handling the toner vessel as aforesaid, wherein a lower portion 6 of a sheet is pulled through a slit 11 on the back of a plate 9. During passage through the slit 11, the sheet is stripped from its flange so that the toner adhered to the lower portion 6 falls, and the toner, having passed through the slit 11 still adhere onto the lower portion 6 without falling, is rubbed off with a projection 12, when the lower portion 6 passes over the projection 12. The toner is stopped by the projection so as not be conveyed further forward and therefore there is no peril of the further forward portion of the back of the plate 9 being stained by the remaining toner.

As the result of this, the plate 9 and the places other than the developing area of the copying machine adjacent thereto can be protected very effectively from being stained by the toner.

Although a particular preferred embodiment of the invention has been disclosed in detail for illustrative purposes, it will be recognized that variations or modifications of the disclosed apparatus, including the rearrangement of parts, lie within the scope of the present invention.

I claim:

1. A toner vessel for use in a copying machine including: a sqaure dish-shaped vessel body which has an opening at its upper part and is provided with an outwardly projecting flange at the peripheral edge of said opening, said vessel receiving the toner therein; a reversely folded cover sheet having an upper part and a lower part, said opening of said vessel body being openably covered with said lower part of said cover sheet, said lower part having a peripheral edge adhered to said outwardly projecting flange; a cover plate which covers said lower part of said cover sheet and is mounted on said vessel body for movement in the horizontal direction; said cover plate having a slit located at the portion of said cover plate near the folded portion of said cover sheet; said upper part of said cover sheet extending through said slit and thence along the back of said cover plate, the improvement which comprises: a projection being provided on the back of said cover plate adjacent to said slit for removing the toner that adheres to the cover sheet, said projection being located on the side of said slit in the direction in which said cover sheet is advanced when said opening is uncovered, said projection slidably contacting the back of said cover sheet.

2. A toner vessel according to claim 1 wherein said cover plate has two side flanges located on opposite sides thereof and which are bent inwardly to form bent portions that define grooves, and wherein said peripheral edge of said vessel body defines two flange portions on opposite sides of said vessel body, said flange portions of said vessel body extending into said grooves of said cover plate.

3. A toner vessel according to claim 1 or claim 2 wherein said projection for removing the toner is made of sponge.

* * * * *